US006854511B2

(12) United States Patent
Kitazaki

(10) Patent No.: US 6,854,511 B2
(45) Date of Patent: Feb. 15, 2005

(54) HEAT EXCHANGER

(75) Inventor: Satoshi Kitazaki, Osaka (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/333,923

(22) PCT Filed: Aug. 2, 2001

(86) PCT No.: PCT/JP01/06668

§ 371 (c)(1),
(2), (4) Date: Oct. 8, 2003

(87) PCT Pub. No.: WO02/12816

PCT Pub. Date: Feb. 14, 2002

(65) Prior Publication Data

US 2004/0069476 A1 Apr. 15, 2004

Related U.S. Application Data

(60) Provisional application No. 60/302,686, filed on Jul. 5, 2001.

(30) Foreign Application Priority Data

Aug. 4, 2000 (JP) ..... 2000-236586

(51) Int. Cl.[7] ..... F28B 1/00
(52) U.S. Cl. ..... 165/110; 165/173
(58) Field of Search ..... 165/110, 173

(56) References Cited

U.S. PATENT DOCUMENTS 5,560,425 A * 10/1996 Sugawara et al. ..... 165/148
5,743,329 A 4/1998 Damsohn et al.
6,056,047 A * 5/2000 Gowan ..... 165/174
6,145,589 A * 11/2000 Gowan ..... 165/174
2002/0153131 A1 * 10/2002 Sugawara et al. ..... 165/173
2003/0085030 A1 * 5/2003 Gowan et al. ..... 165/173

FOREIGN PATENT DOCUMENTS

| | | |
|---|---|---|
| JP | 134280/1988 | 9/1988 |
| JP | 81491/1989 | 5/1989 |
| JP | 5-18690 | 1/1993 |
| JP | 9-113177 | 5/1997 |

* cited by examiner

*Primary Examiner*—Allen J. Flanigan
(74) *Attorney, Agent, or Firm*—Oblon, Spivak, McClelland, Maier & Neustadt, P.C.

(57) ABSTRACT

A heat exchanger includes a header (2) and a plurality of tubes (1) connected thereto. The header (2) includes an inner peripheral wall portion (10) having a generally flattened arc-shaped cross-sectional shape to which the tubes (1) are connected, an outer peripheral wall portion (1) having a generally semi-circular cross-sectional shape which faces to the inner peripheral wall portion (10) and connecting curved peripheral wall portions (12) connecting the inner peripheral wall portion (10) and the outer peripheral wall portion (11). The parameters of the hollow header (2), such as a radius of external curvature Ra of the inner peripheral wall portion (10), a radius of external curvature Rb of the connecting curved peripheral wall portion (12), and a radius of external curvature of the outer peripheral wall portion (11), fall within a specified range, thereby reducing the header capacity and weight while securing sufficient pressure resistance.

18 Claims, 4 Drawing Sheets

HEAT EXCHANGER

CROSS REFERENCE TO RELATED APPLICATIONS

This application is an application filed under 35 U.S.C. § 111(a) claiming the benefit pursuant to 35 U.S.C. § 119(e)(1) of the filing date of Provisional Application No. 60/302,686 filed Jul. 5, 2001 pursuant to 35 U.S.C. § 111(b).

TECHNICAL FIELD

The present invention relates to a heat exchanger suitably used as a condenser for use in car air-conditioning systems, room air-conditioning systems, etc.

BACKGROUND ART

In recent years, the so-called multi flow type heat exchangers have been widely used as, for example, car air-conditioning condensers. In some condensers, as shown in FIG. 4A, a header 100 having a round cross-sectional shape is employed so as to withstand the high pressure of the refrigerant passing through the condenser. On the other hand, as shown in FIG. 4B, a joined type header made by coupling a pair of header halves 102 and 103 is also widely employed.

By the way, since a header is a portion that does not contribute to a heat exchange and constitutes the so-called dead space, it is desirable to make the header capacity as small as possible from the viewpoint of heat exchange efficiency.

In the former header 100 having a circular cross-sectional shape, although the header 100 is excellent in pressure resistance, it is required to have a diameter large enough to allow an insertion of an end portion of the tube 101. This inevitably increases the maximum diameter of the header in the longitudinal direction of the tube 101, resulting in an increased inner capacity of the header 100, or an enlarged dead space that does not contribute to a heat exchange.

On the other hand, in the latter joined type header, since the header has a generally flattened circular cross-sectional shape, it is possible to reduce the Inner capacity of the header, which enables to decrease the dead space to some extent. However, in order to secure enough pressure resistance, it is required to increase the thickness of the inner header half 102 through which the tubes 101 are inserted, which causes an increased header weight. Thus, it was difficult to reduce the weight of the header.

The object of the present invention is to provide a heat exchanger that can reduce the inner capacity of the header while securing enough pressure resistance and lightweight.

DISCLOSURE OF INVENTION

According to the present invention, a heat exchanger includes a hollow header 2, and a plurality of heat exchanging flat tubes 1 connected to the hollow header 2, wherein the hollow header 2 includes an inner peripheral wall portion 10 having a generally flattened arc-shaped cross-sectional shape to which the tubes 1 are connected, an outer peripheral wall portion 11 having a generally semi-circular cross-sectional shape which faces to the inner peripheral wall portion 10 and connecting curved peripheral wall portions 12 and 12 connecting the inner peripheral wall portion 10 and the outer peripheral wall portion 11, and wherein the hollow header 2 fulfills all of the following conditions A to E:

condition A: r=5–15 mm (i.e., from 5 mm to 15 mm);

condition B: Ra≧6r;

condition C: Rb≧4 mm;

condition D: h=4–6 mm (i.e. from 4 mm to 6 mm); and condition E: T=0.1r–0.2r (i.e., from 0.1r to 0.2r), where "Ra" is a radius of curvature of an external surface of the inner peripheral wall portion 10, "Rb" is a radius of curvature of an external surface of the connecting curved peripheral wall portion 12, "r" is a radius of curvature of an external surface of the outer peripheral wall portion 11, "h" is a perpendicular line length from a circular center K of the outer peripheral wall portion 11 to an external surface of the inner peripheral wall portion 10 and "T" is a thickness of a peripheral wall of the header 2.

When the hollow header 2 fulfills all of the aforementioned conditions A to E, the inner capacity of the hollow header 2 can be reduced while securing enough pressure resistance. Furthermore, it is not required to increase the thickness of the header peripheral wall for the purpose of securing pressure resistance, which enables to reduce the header weight. In addition, the existence of the flattened inner peripheral wall portion 10 decreases the perimeter of the header 2, resulting in a decreased header weight, which in turn enables to provide a lightweight heat exchanger.

It is preferable that the hollow header 2 fulfills the following conditions A to E:

condition A: r=8–12 mm (i.e., from 8 mm to 12 mm);

condition B: Ra=48–65 mm (i.e., from 48 mm to 65 mm);

condition C: Rb=4–5 mm (i.e., from 4 to 5 mm);

condition D: h=4.5–5.5 mm (i.e., from 4.5 mm to 5.5 mm); and condition E: T=0.1r–0.2r (i.e., from 0.1r to 0.2r).

It is more preferable that the hollow header 2 fulfills the following conditions A to E:

condition A: r=9.5–10.5 mm (i.e., from 9.5 mm to 10.5 mm);

condition B; Ra=55–62 mm (i.e., from 55 mm to 62 mm);

condition C: Rb=4–4.5 mm (i.e., from 4 mm to 4.5 mm);

condition D: h=4.8–5.2 mm (i.e., from 4.8 mm to 5.2 mm); and condition E: T=0.1r–0.2r (i.e., from 0.1r to 0.2r).

BEST MODE FOR CARRYING OUT THE INVENTION

A heat exchanger according to an embodiment of the present invention will be describe with reference to the attached drawings.

Figure 1A:
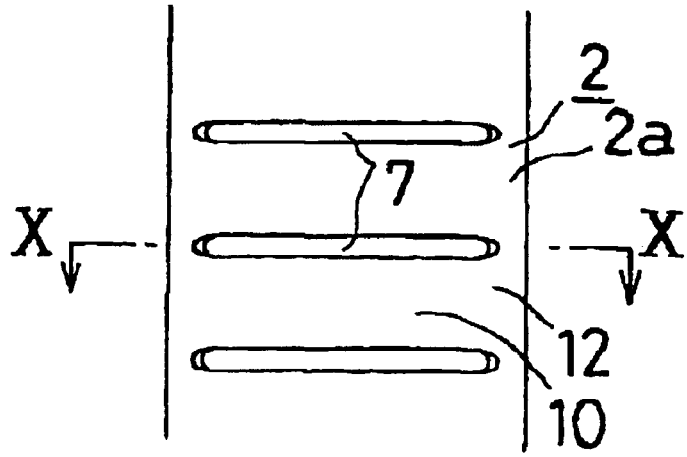
FIG. 1A is a side view of a header seen from the tube connection side thereof.
Figure 1B:
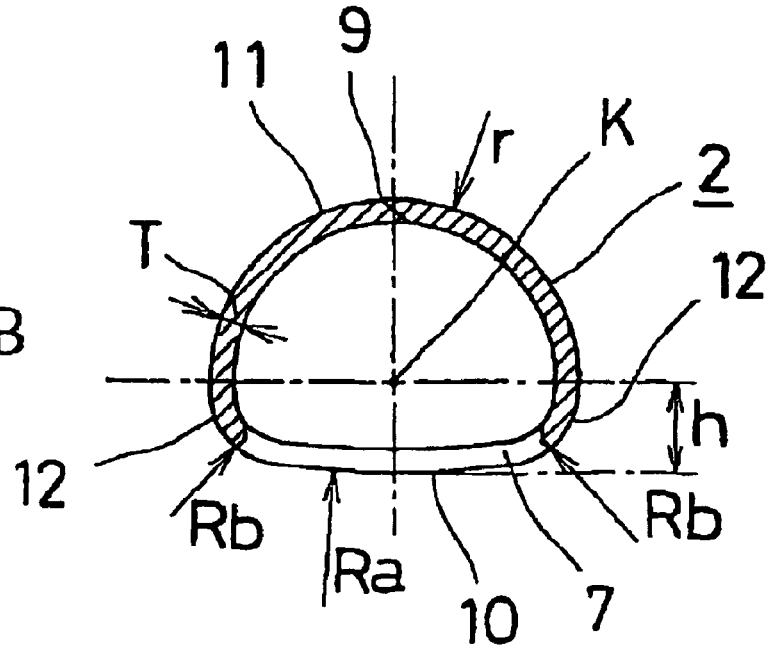
FIG. 1B is a cross-sectional view taken along the line X—X in FIG. 1A.
Figure 2B:
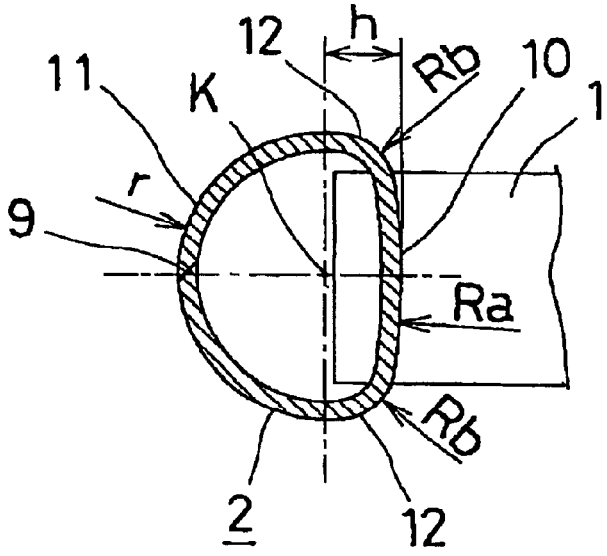
FIG. 2B is a cross-sectional view taken along the line Y—Y in FIG. 2A.
Figure 2C:
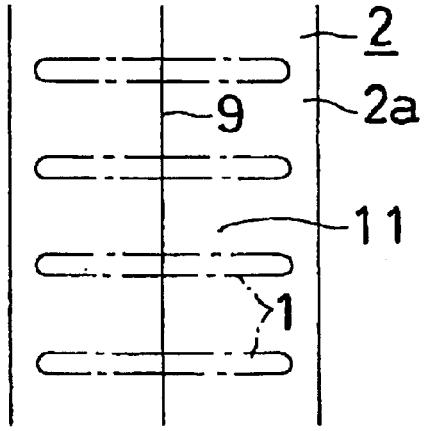
FIG. 2C is a side view of the header.
Figure 2A:
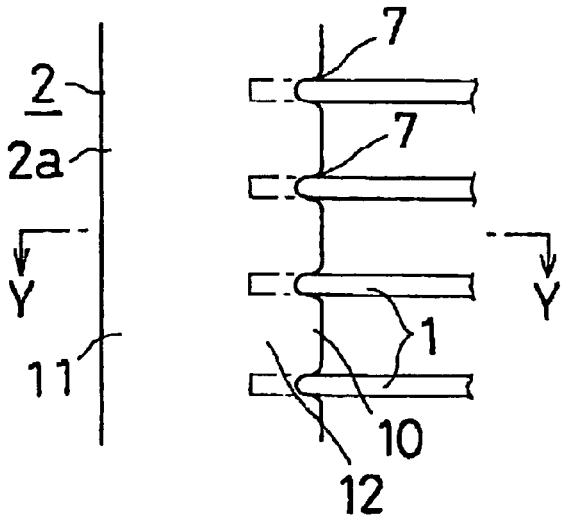
FIG. 2A is a front view showing the principal part of the header to which tubes are connected.
Figure 3B:
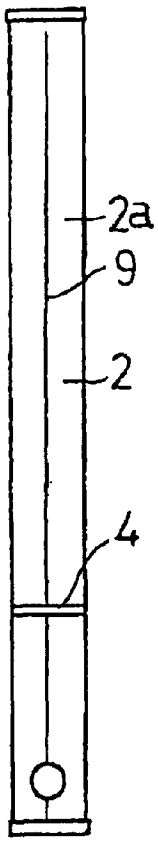
FIG. 3B is a right-hand side view of the heat exchanger.
Figure 3A:
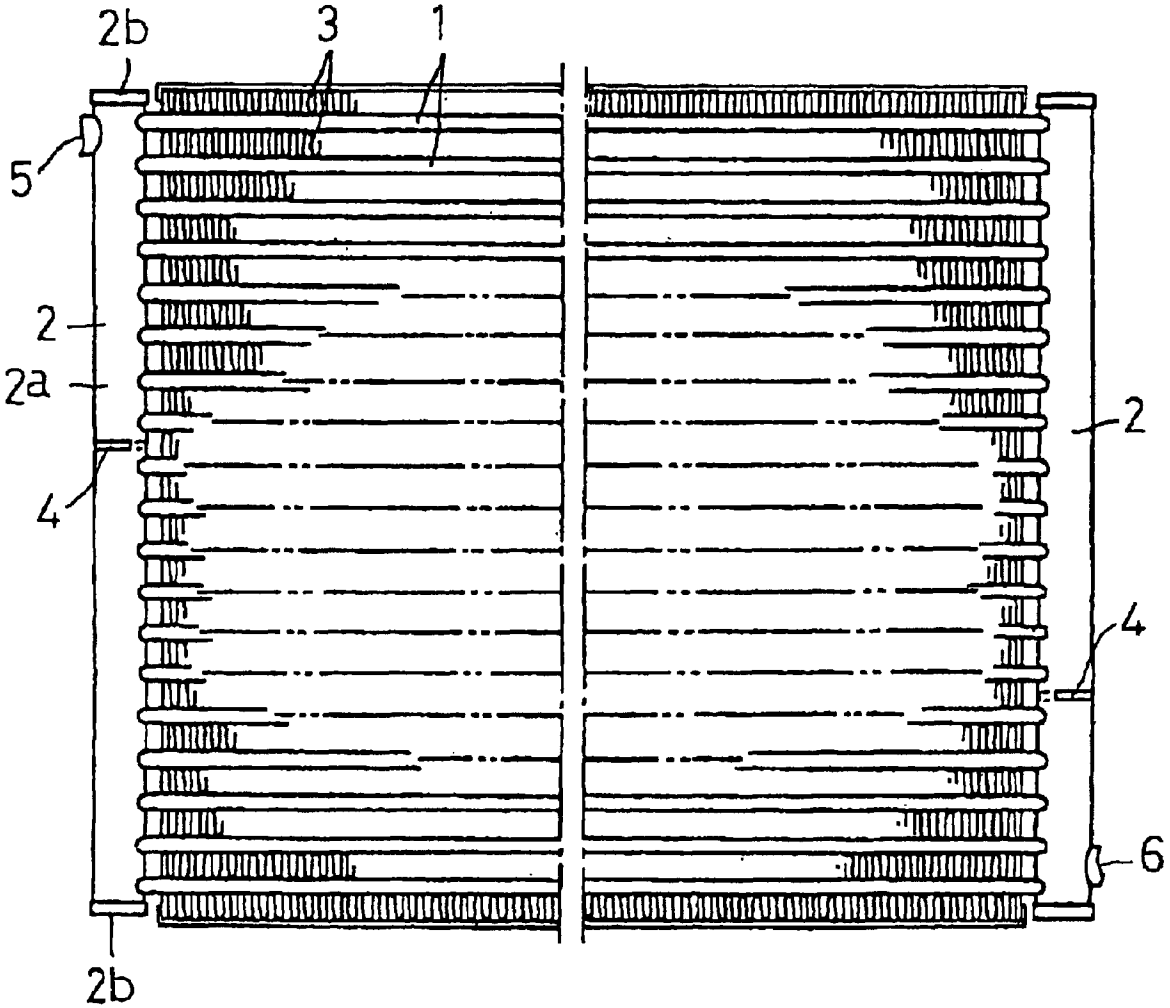
FIG. 3A is a front view showing a heat exchanger.
Figure 4A:
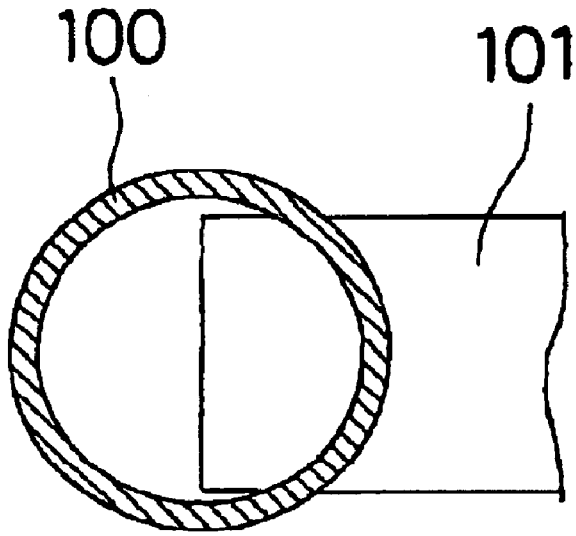
FIGS. 4A and 4B show a cross-sectional view of a header of a conventional heat exchanger, respectively.
Figure 4B:
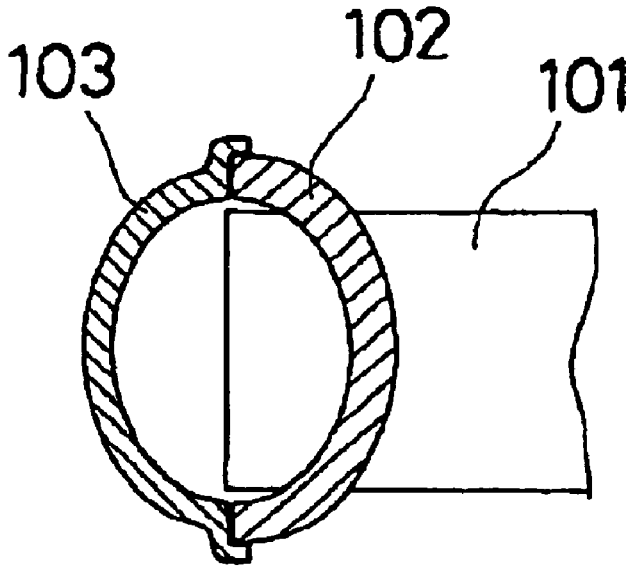

The heat exchanger shown in FIGS. 3A and 3B is an aluminum condenser for use in car air-conditioning systems or room air-conditioning systems. In FIGS. 3A and 3B, the reference numeral 1 denotes a heat exchanging flat tube, 2 denotes a hollow header, 3 denotes a corrugated fin made of an aluminum brazing sheet, 4 denotes a partitioning plate, 5 denotes a refrigerant inlet and 6 denotes a refrigerant outlet.

A plurality of flat tubes 1 are arranged in parallel with each other at predetermined intervals and disposed between a pair of hollow headers 2 and 2 with both ends thereof connected to the headers. The corrugated fins 3 are interposed between the adjacent flat tubes 1 and 1. Except for the header portions 2 and 2, the portion of the heat exchanger including the tubes 1 and fins 3 constitutes a core portion effective to a heat exchange.

The inside space of each hollow header 2 is partitioned by a partitioning plate 4 at predetermined longitudinal portion, and the refrigerant inlet 5 and the refrigerant outlet 6 are connected to the headers 2 and 2 at predetermined longitudinal portion thereof. Thus, the refrigerant introduced through the refrigerant inlet 5 passes through the core portion in a meandering manner and flows out of the refrigerant outlet 6.

The flat tube 1 is the so-call harmonica tube made of an aluminum extruded article having an elongated circular cross-sectional shape, and has upper and lower flat peripheral walls connected by inside walls extending along the longitudinal direction. The flat tube 1 may be an electric welded tube.

Each hollow header 2 is comprised of a cylindrical header pipe 2*a* and a pair of header caps 2*b* and 2*b* covering both ends of the header pipe 2*a*. The header pipe 2*a* is a brazing pipe made by curving an aluminum brazing sheet including a core sheet and a brazing layer clad on one or both surfaces of the core sheet into a pipe so as to abut the side edges each other. At the peripheral wall portion of the header pipe 2*a* opposite to the abutted side edges, a plurality of tube inserting apertures 7 are formed at predetermined intervals. Both end portions of each tube 1 are inserted into the tube inserting apertures 7 and brazed therein. As the aforementioned header pipe 2*a*, an electric welded pipe, an extruded pipe, etc. may be used in place of the aforementioned brazing pipe.

An inner peripheral wall portion of the hollow header 2 located at the tube connecting side is formed into an outwardly expanded generally flattened arc-shaped inner peripheral wall portion 10. On the other hand, the outer peripheral wall portion of the hollow header 2 opposite to the aforementioned inner peripheral wall portion 10 is formed into an outwardly expanded generally semi-circular outer peripheral wall portion 11. The aforementioned flattened arc-shaped inner peripheral wall portion 10 and the semi-circular outer peripheral wall portion 11 are connected by connecting curved peripheral walls 12 and 12 in a smoothly curved manner.

The hollow header 2 having the aforementioned specific configuration fulfills all of the following conditions A to E:

condition A: $r=5–15$ mm;

condition B: $Ra \geqq 6r$;

condition C: $Rb \geqq 4$ mm;

condition D: $h=4–6$ mm; and condition E: $T=0.1r–0.2r$, where "Ra" is a radius of curvature of an external surface of the inner peripheral wall portion 10, "Rb" is a radius of curvature of an external surface of the connecting curved peripheral wall portion 12, "r" is a radius of curvature of an external surface of the outer peripheral wall portion 11, "h" is a perpendicular line length from a circular center K of the outer peripheral wall portion 11 to an external surface of the inner peripheral wall portion 10 and "T" is a thickness of a peripheral wall of the header 2.

The aforementioned flattened arc-shaped inner peripheral wall portion 10 enables to decrease the inner capacity of the header 2. In addition, since the header 2 fulfills the aforementioned conditions A to E, the inner capacity of the hollow header 2 can be decreased while securing enough pressure resistance. Furthermore, since it is not required to increase the thickness T of the header peripheral wall, it is possible to reduce the weight of the header 2. Furthermore, the existence of the flattened arc-shaped inner wall portion 10 decreases the perimeter of the header 2, resulting in reduced weight of the header 2.

If the radius "Ra" of curvature of the external surface of the inner peripheral wall portion 10 becomes less than 6 times as large as the radius "r" of curvature of the external surface of the outer peripheral wall portion 11, it becomes difficult to secure enough pressure resistance. If the radius "Rb" of curvature of the external surface of the connecting peripheral wall portion 12 becomes less than 4 mm, it becomes difficult to secure enough pressure resistance. If the perpendicular line length "h" from the circular center K of the outer peripheral wall portion 11 to the external surface of the inner peripheral wall portion 10 becomes less than 4 mm, it becomes difficult to connect the tube 1 with the header 2 and fulfill the condition B. On the other hand, if it exceeds 6 mm, it becomes difficult to fully reduce the capacity of the header 2. Furthermore, the thickness "T" of the peripheral wall of the header 2 is less than 0.1 times as small as the radius "r" of curvature of the external surface of the outer peripheral wall portion 11, it becomes difficult to secure enough pressure resistance. On the other hand, if it exceeds 02 times, it becomes difficult to keep the header 2 light in weight. Furthermore, the radius "r" of curvature of the external surface of the outer peripheral wall portion 11 fails to fall within the aforementioned range of from 5 mm to 15 mm, it becomes difficult to form the semi-circular outer peripheral wall portion 11 having an appropriate size.

With the aforementioned condenser, a high-pressure gaseous refrigerant is introduced into the core portion through the refrigerant inlet 5, and the refrigerant will exchange heat with the air passing through the core portion in the fore and aft direction while passing through the inner passages to be condensed, and the condensed refrigerant flows out of the refrigerant outlet 6. As mentioned above, the hollow header 2 is constituted by the aforementioned flattened arc-shaped inner peripheral wall portion 10, the aforementioned outer semi-circular peripheral wall portion 11 and the connecting curved peripheral wall portions 12 and 12 connecting the inner and outer peripheral wall portions 10 and 11, and fulfills all of the aforementioned conditions A to E. Accordingly, the header 2 can fully withstand the high pressure of the gaseous refrigerant. Furthermore, the adoption of the flattened arc-shaped inner peripheral wall portion 10 enables to decrease the inner capacity of the header 2, which in turn can reduce the dead space that does not contribute to a heat exchange. As a result, a condenser excellent in heat exchanging efficiency can be obtained.

Next, examples according to the present invention will be explained.

EXAMPLE 1

A hollow header was prepared. The header included an inner peripheral wall portion 10 having a generally flattened arc-shaped cross-sectional shape to which tubes are connected, an outer peripheral wall portion 11 having a generally semi-circular cross-sectional shape which faces to the inner peripheral wall portion 10 and connecting curved peripheral wall portions 12 and 12 connecting the inner peripheral wall portion 10 and the outer peripheral wall portion 11 and fulfills the following conditions. Then, a condenser as shown in FIG. 3 was manufactured by using the aforementioned hollow headers.

condition A: r=10 mm, condition B: Ra=60 mm, condition C: Rb=4 mm, condition D: h=5 mm; and condition E: T=1.3 mm Assuming that the generating stress in a conventional round header is 100%, the generating stress in this header was 163%. Thus, in this example, it is confirmed that the generating stress is suppressed small and enough pressure resistance can be obtained.

Also confirmed are that the inner capacity of the header is reduced by approximately 25% as compared with the conventional round header and that the perimeter of the header is reduced by approximately 10% as compared with the conventional round header and therefore the header weight is reduced by approximately 10%. Thus, it is confirmed that a lightweight header can be provided.

EXAMPLE 2

In Example 2, the same structure as in Example 1 was employed, but the conditions were set as follows:

condition A: r=7.94 mm, condition B: Ra=50 mm, condition C: Rb=4 mm, condition D: h=4 mm; and condition E: T=1.1 mm Assuming that the generating stress in a conventional round header is 100%, the generating stress in this header was 146%. Thus, in this example, it is confirmed that the generating stress is suppressed small and enough pressure resistance can be obtained.

COMPARISON EXAMPLES

Under the following conditions, similar evaluations were conducted. The results are shown in Table 1.

The condition B (Ra=20, 30, 40, 50 and 60 mm) and the condition C (Rb=2, 3 and 4 mm) were set as shown in Table 1, and the condition A (r=10 mm), the condition D (h=5 mm) and the condition E (T=1.3 mm) were fixed.

From these results of the comparison examples, it is confirmed that the generating stress is large and it is difficult to secure enough pressure resistance.

TABLE 1

Generating stress in the header (Relative comparison value when the generating stress in a conventional round header is 100)

| | | Ra (mm) | | | | |
|---|---|---|---|---|---|---|
| | | 20 | 30 | 40 | 50 | 60 |
| Rb (mm) | 2 | 202 | 319 | 393 | 303 | 228 |
| | 3 | 265 | 187 | 251 | 214 | 237 |
| | 4 | — | 202 | 208 | 173 | 163* |

TABLE 1-continued

Generating stress in the header (Relative comparison value when the generating stress in a conventional round header is 100)

| | Ra (mm) | | | | |
|---|---|---|---|---|---|
| | 20 | 30 | 40 | 50 | 60 |

(r = 10 mm, h = 5 mm, T = 1.3 mm)

*denotes the data of Example 1, and the remainder are the data of comparative examples. The data in Example 2 is not listed in Table 1.

Effects of the Invention

With the heat exchanger according to the present invention, a hollow header 2 is constituted by a flattened arc-shaped inner peripheral wall portion 10, an outer semi-circular peripheral wall portion 11 and connecting curved peripheral wall portions 12 and 12 connecting the inner and outer peripheral wall portions 10 and 11. Thus, the adoption of the flattened arc-shaped inner wall portion 10 enables to reduce the inner capacity of the header 2. Furthermore, since the hollow header 2 fulfills all of the aforementioned conditions A to E, the header 2 can decrease the inner capacity thereof while fully securing the high-pressure resistance. Accordingly, the dead space that does not contribute to a heat exchange can be decreased, resulting in excellent heat exchanging efficiency.

Furthermore, since it is not required to increase the thickness T of the header peripheral wall in order to secure the pressure resistance, the weight of the header 2 will not be increased. Accordingly, a lightweight heat exchanger can be provided. In addition, the existence of the flattened arc-shaped inner peripheral wall portion 10 results in a decreased perimeter of the header 2, causing a further reduced weight of the header 2.

Since the peripheral wall portion to which tubes are connected is formed into a flattened arc-shaped inner peripheral wall portion 10, the brazing length between the header 2 and the tube 1 becomes shorter, resulting in no brazing defect and easy tube fabrication.

INDUSTRIAL APPLICABILITY

The present invention can be applied to a heat exchanger that enough pressure resistance and reduced header capacity are required, such as a condenser for use in car air-conditioning systems or room air-conditioning systems.

What is claimed is:

1. A heat exchanger, comprising:

a hollow header; and a plurality of heat exchanging tubes connected to said hollow header, wherein said hollow header includes an inner peripheral wall portion having a generally flattened arc-shaped cross-sectional shape to which said tubes are connected, an outer peripheral wall portion having a generally semi-circular cross-sectional shape which faces to said inner peripheral wall portion and connecting curved peripheral wall portions connecting said inner peripheral wall portion and said outer peripheral wall portion, and wherein said hollow header fulfills all of the following conditions A to E:

condition A: r=5–15 mm;

condition B: Ra≧6r;
condition C: Rb≧4 mm;
condition D: h=4–6 mm; and
condition E: T=0.1r–0.2r, where "Ra" is a radius of curvature of an external surface of said inner peripheral wall portion, "Rb" is a radius of curvature of an external surface of said connecting curved peripheral wall portion, "r" is a radius of curvature of an external surface of said outer peripheral wall portion, "h" is a perpendicular line length from a circular center of said outer peripheral wall portion to an external surface of said inner peripheral wall portion and "T" is a thickness of a peripheral wall of said header.

2. A heat exchanger, comprising:

a pair of hollow headers disposed parallel with each other at a predetermined distance; and a plurality of heat exchanging tubes disposed between said hollow headers with opposite ends thereof connected to said hollow headers, wherein said hollow header includes an inner peripheral wall portion having a generally flattened arc-shaped cross-sectional shape to which said tubes are connected, an outer peripheral wall portion having a generally semi-circular cross-sectional shape which faces to said inner peripheral wall portion and connecting curved peripheral wall portions connecting said inner peripheral wall portion and said outer peripheral wall portion, and wherein said hollow header fulfills all of the following conditions A to E:
condition A: r=5–15 mm;
condition B: Ra≧6r;
condition C: Rb≧4 mm;
condition D: h=4–6 mm; and
condition E: T=0.1r–0.2r, where "Ra" is a radius of curvature of an external surface of said inner peripheral wall portion, "Rb" is a radius of curvature of an external surface of said connecting curved peripheral wall portion, "r" is a radius of curvature of an external surface of said outer peripheral wall portion, "h" is a perpendicular line length from a circular center of said outer peripheral wall portion to an external surface of said inner peripheral wall portion and "T" is a thickness of a peripheral wall of said header.

3. The heat exchanger as recited in claim 1, wherein said hollow header fulfills the following conditions:

condition A: r=8–12 mm;

condition B: Ra=48–65 mm;

condition C: Rb=4–5 mm;

condition D: h=4.5–5.5 mm; and condition E: T=0.1r–0.2r.

4. The heat exchanger as recited in claim 1, wherein said hollow header fulfills the following conditions:

condition A: r=9.5–10.5 mm;

condition B: Ra=55–62 mm;

condition C: Rb=4–4.5 mm;

condition D: h=4.8–5.2 mm; and condition E: T=0.1r–0.2r.

5. The heat exchanger as recited in claim 1, wherein said heat exchanger is a condenser for use in a refrigeration cycle of car air-conditioning systems.

6. The heat exchanger as recited in claim 1, wherein said header is provided with a plurality of tube insertion apertures formed in said inner peripheral wall portion along a longitudinal direction thereof at predetermined intervals, and wherein an end portion of each of said tubes is inserted into said tube insertion aperture and secured therein.

7. The heat exchanger as recited in claim 6, wherein said header includes a cylindrical header pipe and header caps closing both ends of said header pipe.

8. The heat exchanger as recited in claim 7, wherein said header pipe is a brazing pipe formed by curving an aluminum brazing sheet having a core sheet and a brazing layer clad thereon into a pipe so as to abut opposite side edges thereof each other.

9. The heat exchanger as recited in claim 8, wherein said tube insertion aperture are formed in a peripheral wall portion opposite to a peripheral wall portion having an abutted portion of said side edges.

10. The heat exchanger as recited in claim 7, wherein said header pipe is an extrusion pipe.

11. The heat exchanger as recited in claim 2, wherein said hollow header fulfills the following conditions:

condition A: r=8–12 mm;

condition B: Ra=48–65 mm;

condition C: Rb=4–5 mm;

condition D: h=4.5–5.5 mm; and condition E: T=0.1r–0.2r.

12. The heat exchanger as recited in claim 2, wherein said hollow header fulfills the following conditions:

condition A: r=9.5–10.5 mm;

condition B: Ra=55–62 mm;

condition C: Rb=4–4.5 mm;

condition D: h=4.8–5.2 mm; and condition E: T=O.r.–0.2r.

13. The heat exchanger as recited in claim 2, wherein said heat exchanger is a condenser for use in a refrigeration cycle of car air-conditioning systems.

14. The heat exchanger as recited in claim 2, wherein said header is provided with a plurality of tube insertion apertures formed in said inner peripheral wall portion along a longitudinal direction thereof at predetermined intervals, and wherein an end portion of each of said tubes is inserted into said tube insertion aperture and secured therein.

15. The heat exchanger as recited in claim 14, wherein said header includes a cylindrical header pipe and header caps closing both ends of said header pipe.

16. The beat exchanger as recited in claim 15, wherein said header pipe is a brazing pipe formed by curving an aluminum brazing sheet having a core sheet and a brazing layer clad thereon into a pipe so as to abut opposite side edges thereof each other.

17. The heat exchanger as recited in claim 16, wherein said tube insertion aperture are formed in a peripheral wall portion opposite to a peripheral wall portion having an abutted portion of said side edges.

18. The beat exchanger as recited in claim 15, wherein said header pipe is an extrusion pipe.

* * * * *